US011274436B2

(12) United States Patent
Angeli

(10) Patent No.: US 11,274,436 B2
(45) Date of Patent: Mar. 15, 2022

(54) METHOD FOR PRODUCING A CONSTRUCTION OF INTERCONNECTED WOODEN PANELS

(71) Applicant: ROTHO BLAAS GMBH/SRL, Cortaccia Bolzano (IT)

(72) Inventor: Albino Angeli, Cortaccia Bolzano (IT)

(73) Assignee: ROTHO BLAAS GMBH/SRL, Cortaccia Bolzano (IT)

( * ) Notice: Subject to any disclaimer, the term of this patent is extended or adjusted under 35 U.S.C. 154(b) by 0 days.

(21) Appl. No.: 16/961,270

(22) PCT Filed: May 14, 2019

(86) PCT No.: PCT/EP2019/062295
§ 371 (c)(1),
(2) Date: Jul. 10, 2020

(87) PCT Pub. No.: WO2019/224047
PCT Pub. Date: Nov. 28, 2019

(65) Prior Publication Data

US 2021/0062499 A1 Mar. 4, 2021

(30) Foreign Application Priority Data

May 24, 2018 (IT) ..... 102018000005662

(51) Int. Cl.
*E04B 1/61* (2006.01)
*E04C 2/14* (2006.01)

(52) U.S. Cl.
CPC ..... *E04B 1/6162* (2013.01); *E04C 2/14* (2013.01)

(58) Field of Classification Search
CPC . E04B 1/6162; E04B 1/38; E04B 1/40; E04B 2001/386; E04B 1/6145; E04B 1/61; E04B 1/6108; E04C 2/14; E04C 2/12; E04C 2/10; E04C 2/16; F16B 5/0008; F16B 5/0028; F16B 5/0072; F16B 2/06
See application file for complete search history.

(56) References Cited

U.S. PATENT DOCUMENTS 2,373,808 A * 4/1945 Brown ..... F16B 5/0072 52/471
4,045,927 A * 9/1977 Diaz ..... E04B 1/6162 52/127.11
4,052,832 A * 10/1977 Jungers ..... E04B 1/32 52/779

(Continued)

FOREIGN PATENT DOCUMENTS

DE 10044016 3/2002
DE 202016102078 6/2016

(Continued)

OTHER PUBLICATIONS

International Search Report.

*Primary Examiner* — Patrick J Maestri
(74) *Attorney, Agent, or Firm* — Jacobson Holman PLLC

(57) ABSTRACT

A method for producing a constructions having a structural component (100), in particular a wall, a ceiling or the like, formed by a plurality of interconnected wooden panels (1, 2, 3). The wooden panels (1, 2, 3) are connected to one another to produce a structural component (100) which is formed from at least two wooden panels (1, 2, 3).

11 Claims, 7 Drawing Sheets

(56) References Cited

U.S. PATENT DOCUMENTS

| | | | | |
|---|---|---|---|---|
| 6,345,927 | B1 * | 2/2002 | Pao | G21C 13/087 403/294 |
| 10,309,098 | B2 * | 6/2019 | Chadwell | F16B 37/002 |
| 2015/0099083 | A1 * | 4/2015 | Spieth | E04C 2/30 428/53 |
| 2015/0354204 | A1 * | 12/2015 | Kinnunen | F16B 2/065 248/228.5 |
| 2018/0355604 | A1 * | 12/2018 | Schilcher | E04B 1/6162 |
| 2019/0078598 | A1 * | 3/2019 | Bogdanovich | F16B 5/01 |
| 2019/0390455 | A1 * | 12/2019 | Knapp | F16B 5/121 |
| 2020/0149265 | A1 * | 5/2020 | Moller | E04B 1/942 |

FOREIGN PATENT DOCUMENTS

| | | |
|---|---|---|
| EP | 0117205 | 8/1984 |
| EP | 0886016 | 12/1998 |
| KR | 101060983 | 8/2011 |
| WO | WO 0020705 | 4/2000 |
| WO | WO 2012139601 | 10/2012 |
| WO | WO 2014 153574 | 10/2014 |
| WO | WO 2017089309 | 6/2017 |

* cited by examiner

METHOD FOR PRODUCING A CONSTRUCTION OF INTERCONNECTED WOODEN PANELS

BACKGROUND ON THE INVENTION

Method for producing a structure with a structural component, in particular a wall, a floor or the like, formed by a plurality of interconnected timber panels, a structural component, a wall produced using this method and a connecting element for timber panels.

The present invention relates to a method for producing a structure with a structural component, in particular a wall, a floor or the like, formed by a plurality of interconnected timber panels, a structural component, for example a wall produced by this method and a connecting element for timber panels, in particular timber panels with glued or mechanical connection, for example XLAM or CLT cross layers, to produce such a wall.

Numerous elements for the connection of timber panels are known. The biggest problem is the manufacture of an element is that it is easy to mount during assembly, while ensuring all required strength and rigidity characteristics.

Furthermore, a monolithic behavior of the connected timber panels is required. Due to the monolithic feature, a plurality of timber panels behave like a single timber panel, which can only be connected by attaching them to the ends, avoiding that they tip over and not having to fix each individual timber panel.

A kit for surfaces is known from WO 2012 13 96 01 A1, comprising a plurality of essentially rectangular panels, each panel comprising an upper and a lower surface and side walls. The side walls have opposite openings in order to insert a connecting element having a cruciform cross-section.

The connection thus produced cannot be isolated and, due to the necessary play, a stable molded coupling is not possible, whereby no monolithic structure of the timber panels can be ensured.

The publication WO 2012 13 96 01 A1 does not describe any approaches for producing stiffness and strength in the timber panel plane. A connection is proposed in order to connect the panels outside the plane of the laminate parquet or cladding panels for walls.

An element for connecting timber panels is known from KR 10-1060983. The element for connecting timber panels described in the Korean application is also sunk in the panel. A stable molded coupling is not possible in this case also, and no monolithic structure of the panels can be ensured.

DE 10044016 describes a device for connecting floor panels to a timber core, in particular mdf or hdf, where at least one section having a dovetail-like groove, which is opposite a second panel with a mirrored dovetail-shaped groove, and wherein these panels are connected by means of a connecting element without play. The connection described requires a high level of precision and is only intended for connecting floors, and installation after laying the panel is not possible.

The publication WO 2011/089309 describes a component formed as two components facing away on its opposite narrow side, which comprises a plurality of connecting elements which connect the precharged components, and where the components have undercut recesses in which the connecting elements formed by two dovetail-shaped timber parts are inserted. The undercut element has a lower thickness in the contact area between the two components and the connection is therefore exposed to a high risk of breakage.

The publication WO 2014153574 describes a component formed by two panels which are connected along the entire width by means of, for example, two wedge-shaped parts which connect to each another. The connection is a linear connection with the disadvantage that it has no resistance and rigidity to shear stresses in the panel plane.

The walls made of timber panels can also be made with single panels. However, this means a number of manufacturing, storage, movement, and transportation problems posed by the dimensions or weight of the walls. In addition, each wall generally has specific dimensions that prevent series and standard production. This problem is often solved by the production of panels with a moderate and standardized width, which can be joined in the factory or at the construction site. The panels of the prior art are joined with screws that work under shear, possibly by interposing a slide. This type of connection does not allow a sufficient level of rigidity to be obtained. These systems also do not allow the panels to be clamped together.

EP 088 601 describes a dowel for connecting two panels. This dowel is formed with a uniform cross section and in which the outer parts are wider in order to be clamped in the openings which have recesses. The dowel described is intended for the connection of two panels, but only with one sealing element and not with the formation of a tensile connection, which is only ensured by clamped with, for example, clamping devices such as screws and the like. Furthermore, as explained in the subject matter, the dowel is provided in order to connect the panels with insulating material on their inside and are therefore not structural, but simply insulating panels. In addition, the recess formed in the sluts in the panels does not allow a tensile force to be generated between the panels. The connection described in this publication does not allow a monolithic structure to be formed between the two panels.

EP 0 117 205 describes a method for connecting two panels. Also in this case, the two panels have a recess in order to be fastened within this recess by the connecting device.

The connection is also made between the two panels from top to bottom along the entire contact area. Also in this case, it is not possible to insert clamping means in order to fasten the two panels and to form a monolithic structure. Also in this case, the connection to the outside for the formation of a tensile structure is not described, which is essential for calculating the statics of a construction.

WO 00/20705 describes a connection between two panels, in particular for the formation of a floor. Also in this case, a connection with a recess allowing the connection dowel to be clamped is described. This structure also does not have the monolithic features after the connection and moreover it is not intended to have structural features.

The problem that is solved by the method described in the present specification to produce a structure that has interconnected panels that form a monolithic unit and that is connected to the floor via tension elements allows a quick and reliable calculation of the statics of a structure, whereby the calculations can be limited to the specified tension points and the structure does not have to be calculated and dimensioned for each individual panel or a part of the panel, but only for the entire structure, thus ensuring a more efficient and faster construction, reduction of planning costs, and the more efficient use by the calculation systems.

SUMMARY OF THE INVENTION

The object of the present invention is a method for producing a construction with a structural component, for example a wall or a floor, which is formed by a plurality of interconnected timber panels according to the claims, which solves the problems mentioned, in particular a manufacture of a structural component, for example a wall, a floor or the like, which is formed by a plurality of panels with monolithic features.

The method for producing a structural component, for example a wall, a floor or the like, which is formed by a plurality of timber panels according to the invention, has interconnected panels for producing a structural component which is formed by a multiplicity of panels, the method including the following steps:

- positioning of at least two timber panels which fit together according to a support surface which is, for example, perpendicular to the end faces forming the structural component;
- formation of a cavity on the surface of two panels at the edges of the panels facing each other, with an open cavity on at least one end face of the panel; wherein the adjacent cavities forming a single receptacle,
- pressing in a connecting element perpendicular to the receptacle;
- clamping the connecting element by means of clamping elements essentially in an inclined direction between 30° and 70° relative to the contact surface of the panels, and closing of the connecting joint between the two panels;
- wherein at least two panels form the structural component with only two tensile connections to another structure,
- covering the receptacle with a tape.

It is understood that the order of the steps may also be changed without leaving the protected area.

In a first embodiment, the receptacle is formed by a hollow-like cavity perpendicular to the connection of the two panels to be connected. The structure is formed by at least two panels, at least two of which are firmly attached to another structure or the like. The structural element produced in this way has a monolithic behavior. This becomes important in the event of earthquakes or other loads perpendicular to the connection surface. In a preferred embodiment, these cavities are not continuous; for panels of low thickness, the cavities may also be continuous. The cavities can also be executed in the factory before the panels are transported to the construction site or may be executed directly at the construction site, in particular after the panels have been positioned. This ensures that the cavities between abutted panels are aligned.

Advantageously, at least two cavities are formed, each of which extends over two panels, for connecting two panels, in which at least one connecting element is introduced in each receptacle.

Advantageously, the panels consist of at least three layers of timber. The timber layers are superimposed and connected to each other in such a way that the fiber of each individual timber ply in the panel plane is preferably rotated by 90 degrees with respect to the adjacent layers, or in general the panels can consist of lamellar timber.

According to the invention, the connecting element has a longitudinal body with at least two seats for screws. The seats of the screws face away from each other. The seat for the screws is essentially inclined by 30°-70° with respect to the contact surface of the panels and the seats are diametrically opposed to each another.

Advantageously, the screw traverses at least two timber layers of the panel.

In one embodiment, the internal structure of the connecting element of the one row has ribs parallel to the plane of the panel and these are arranged on each of the timber ply forming the panels, i.e. one rib for each layer of timber.

In one version, the cavities are filled with a foam after insertion, in particular a polyurethane foam. In this way, the connection is additionally sealed and the heat transfer of the connection is reduced.

Advantageously, the connecting element has a number of gaps.

DESCRIPTION OF THE DRAWINGS

Further features and details of the method for producing a connection for panels XLAM or CLT and for a preferred and non-limiting embodiment of a connecting element according to the invention explained here are clear from the following description and with reference to the accompanying drawings. Following a description of the Figures.

DETAILED DESCRIPTION OF THE INVENTION

Figure 1A:
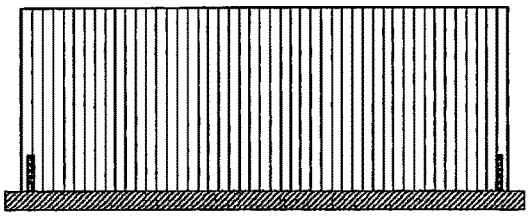
Fig. 1A Prior Art
FIG. 1A is an end view of a wall composed of a single panel according to the prior art.
Figure 1B:
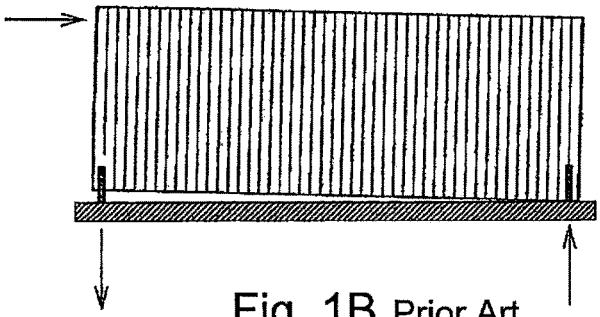
Fig. 1B Prior Art
FIG. 1B shows the behavior of the wall from FIG. 1A under side loads.
Figure 2A:
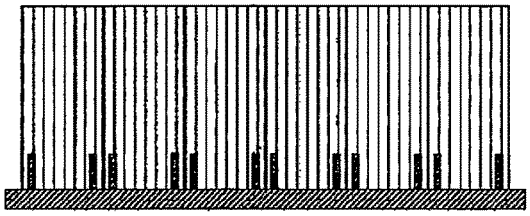
Fig.2A Prior Art
FIG. 2A is an end view of a wall according to the invention.
Figure 2B:
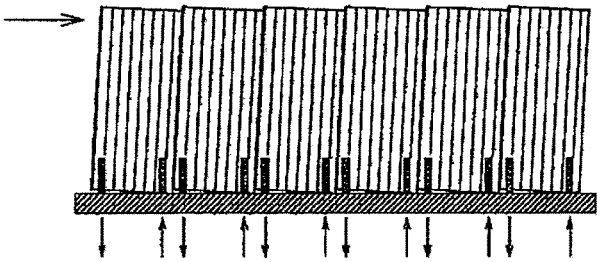
Fig. 2B Prior Art
FIG. 2B shows the behavior of the wall from FIG. 2A under side loads.

FIG. 1A illustrates a structural component, for example a wall formed by a single panel according to the prior art. FIG. 1B shows its behavior under loads, for example loads that may result from an earthquake or wind. FIG. 2A shows a wall according to the prior art formed by a series of panels which are not connected to one another in monolithic form. FIG. 2B shows the behavior under load, for example from an earthquake, wind or the like. As it can be derived from FIG. 2B, the individual panels allow a relative displacement/movement between the individual panels. This displacement could cause damage to the structure, e.g. by cracking or sagging.

Figure 3A:
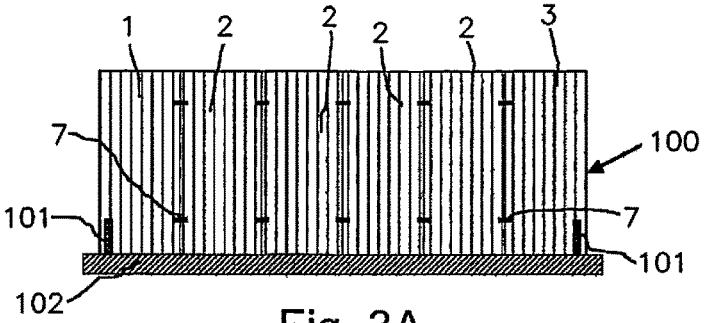
FIG. 3A is an end view of a wall according to the invention.
Figure 3B:
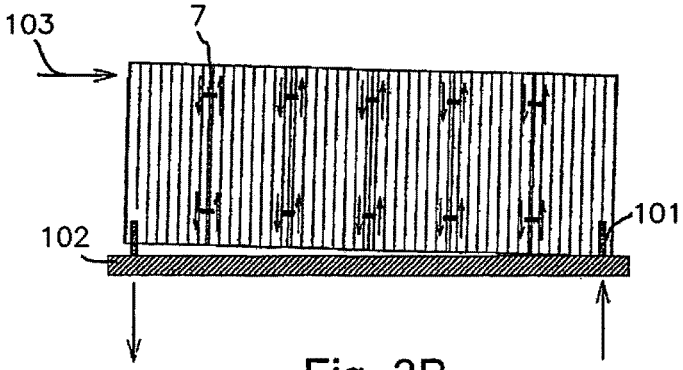
FIG. 3B shows the behavior of the wall from FIG. 3A under side loads.

FIG. 3A shows a structural component 100 which was produced by a method according to the invention and is formed by a series of panels 1, 2, 3 which are connected via a series of connecting elements 7, 17 according to the invention. The panel is attached to another structure 102 or the like via tensile connections 101. FIG. 3B shows the behavior of the wall produced by the method according to the invention and shows the monolithic behavior when subjected to a force 103. The monolithic behavior gives the wall high rigidity, reducing damage due to earthquakes and similar exposed buildings and allowing the number of connections 101 to be reduced.

Figure 4A:
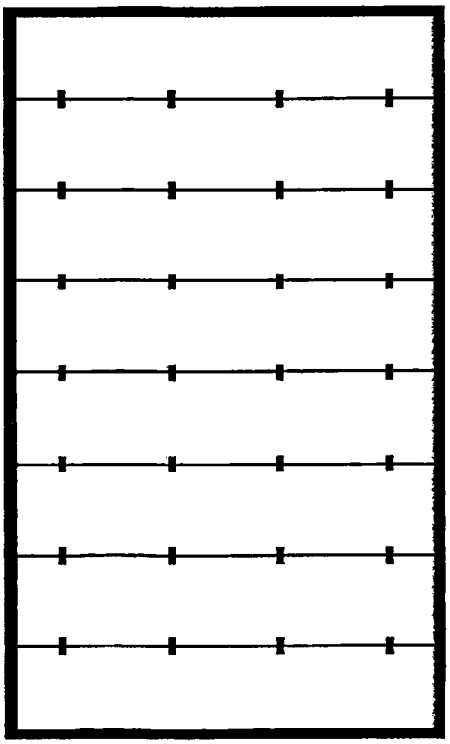
FIG. 4A is a top view of the floor according to the invention in a second embodiment.
Figure 4B:
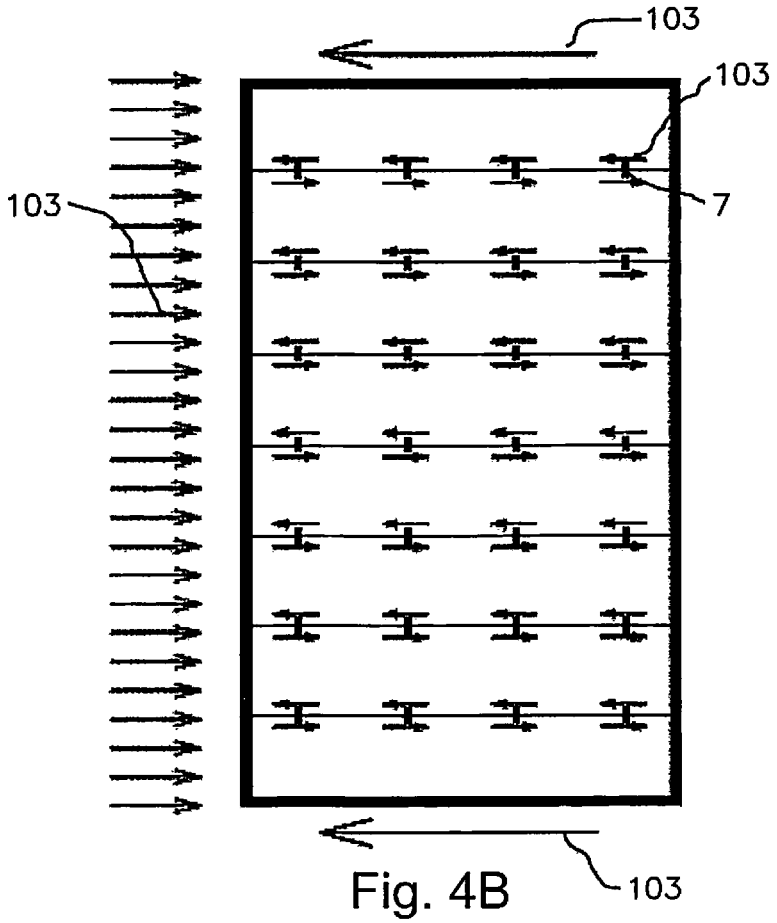
FIG. 4B shows the behavior of the floor from FIG. 4A under loads.
Figure 5:
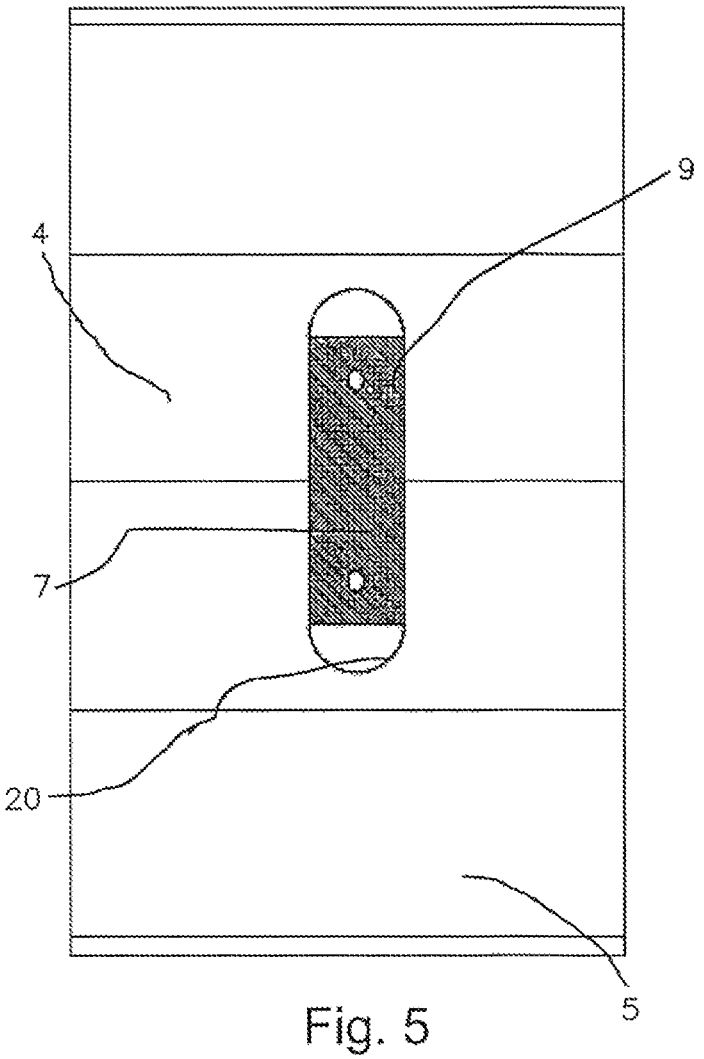
FIG. 5 is an inserted end view of an inventive element.
Figure 6:
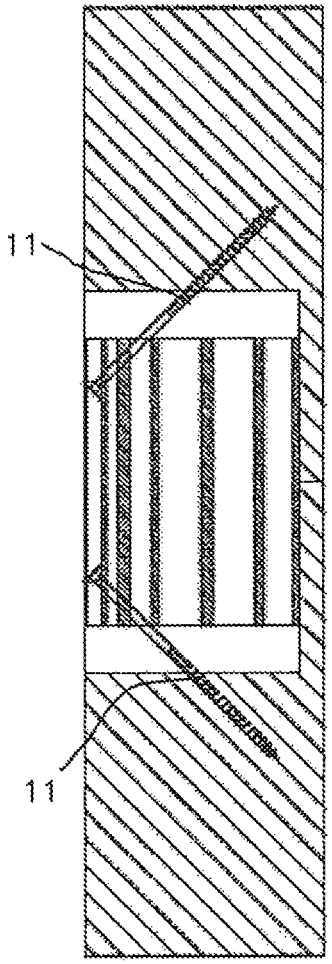
FIG. 6 is a sectional view from FIG. 5.
Figure 7:
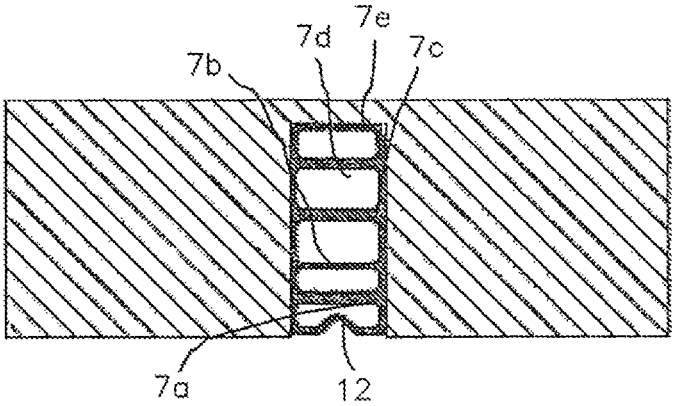
FIG. 7 is a sectional view from FIG. 5 rotated with respect to FIG. 6.
Figure 8:
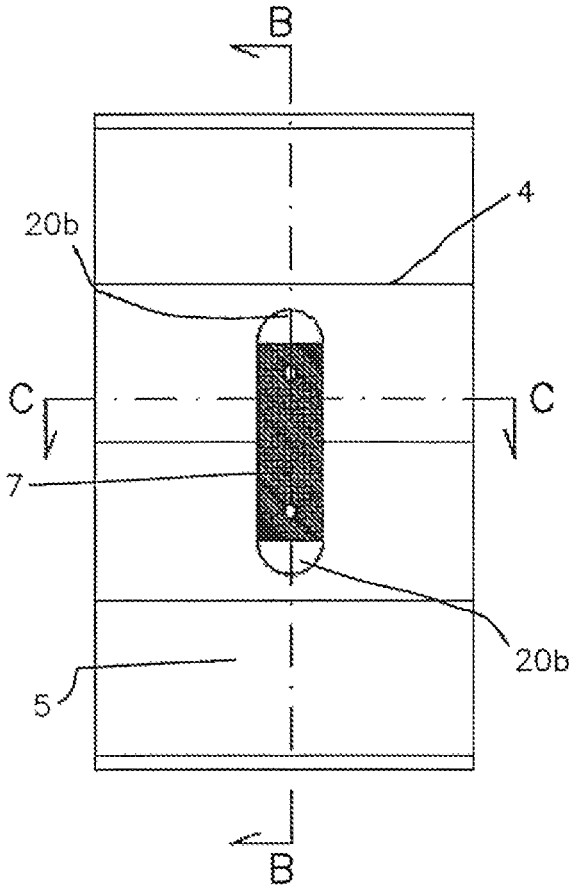
FIG. 8 is an inserted end view of an inventive element in another panel.
Figure 9:
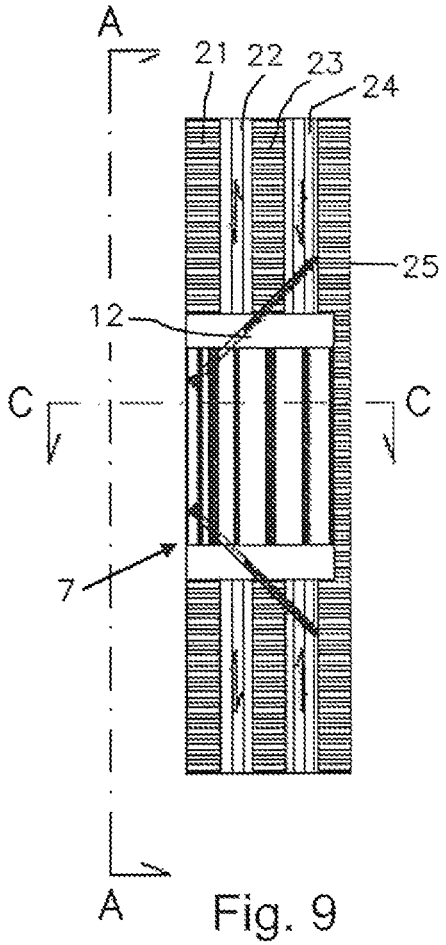
FIG. 9 is a horizontal sectional view from FIG. 8.
Figure 10:
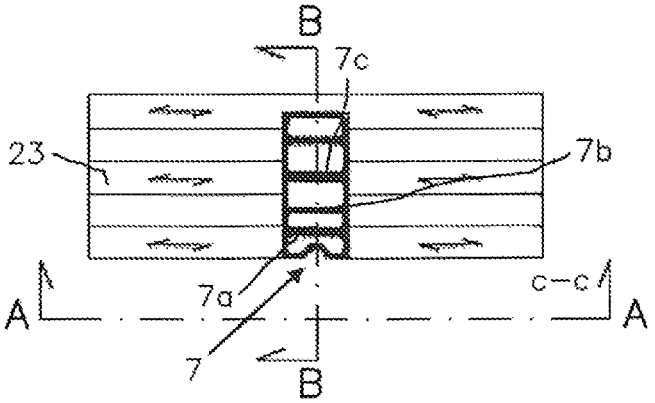
FIG. 10 is a vertical sectional view from FIG. 8.
Figure 11:
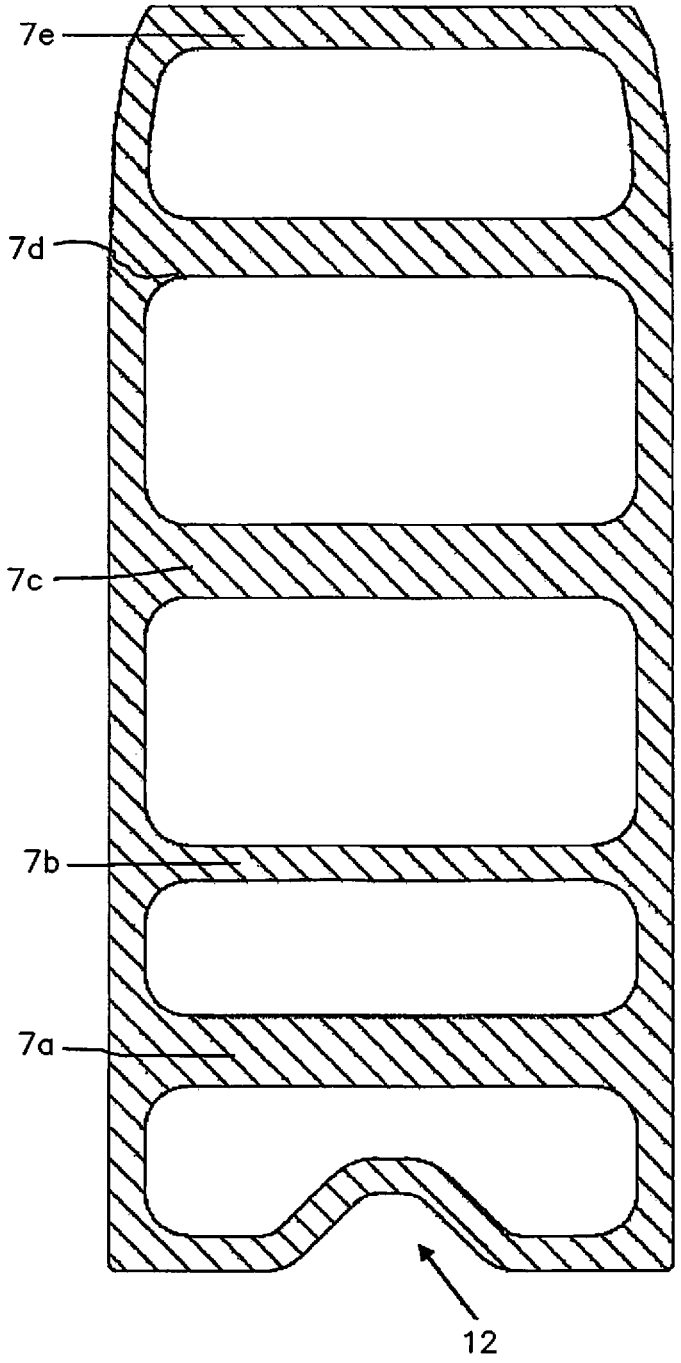
FIG. 11 shows a sectional view of a connecting element according to the invention.
Figure 12:
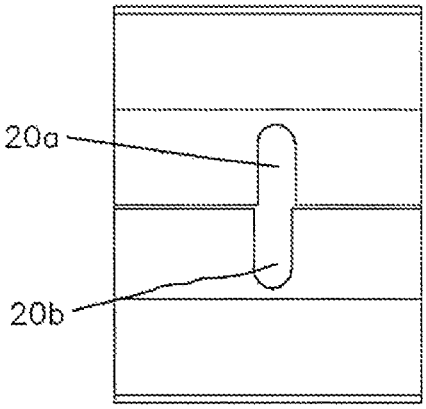
FIG. 12 shows two panels with an offset cavity.
Figure 13:
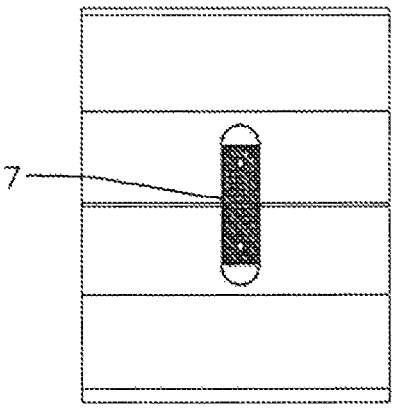
FIG. 13 shows two aligned panels connected by a connecting element.

FIGS. 4A and 4B show a floor produced according to the invention, indicating the forces 103 in FIG. 4B to which the individual panels are exposed and the connections made by the connecting element 7 according to the invention. The monolithic behavior of the floor makes it possible to reduce damage to the building due to an earthquake or the like.

For the execution of a method according to the invention, cavities 20, 20*a* and 20*b* are made in timber panels 1, 2, 3 are created in a first step, in particular in panels XLAM or CLT or the like, on one of the surfaces 4, 5 of the panels 1, 2 which match and form the wall to be created, 2, 3.

In one embodiment, these panels consist of at least three panel layers or boards. The panel layers are superimposed and connected to one another so that the fibers of each layer 21, 22, 23, 24 and 25 in the panel plane are rotated by 90° with respect to the adjacent layers, or in general the panels are made of lamellar timber.

These cavities 20, 20*a* and 20*b* are produced, for example, by means of a CNC or else via a portable machine at the construction site, which mills a recess or opening on the adjacent edges of the panels 1, 2, 3, and thereby forms the cavities. The cavities 20, 20*a* and 20*b* are not continuous for panels of larger width in the direction perpendicular to the surface of the wall. In these cavities 20, 20*a* and 20*b*, the connecting element 7, 17 is pressed, which is formed by a metal element or a fiber-reinforced polymer, which has a series of ribs 7*a*, 7*b*, 7*c*, 7*d*, 7*e* which are parallel to the plane of the panel and which are advantageously arranged in relation to each of the timber ply 21, 23, 23, 24 and 25 forming the panel 1, 2, 3. In one embodiment, for example, five ribs are present, including the bottom surface of the connecting elements 7, 17. These ribs 7*a*, 7*b*, 7*c*, 7*d*, 7*e* can be dimensioned depending on the orientation of the timber ply. The ribs with the most load can be formed with a greater thickness in order to withstand better or if the panel should only be made up of three layers, the connecting element can also have five ribs 7*a*, 7*b*, 7*c*, 7*d*, 7*e*. In this case, two ribs work together to absorb the stresses of a timber ply 21, 22, 23, 24, 25.

After insertion, the connecting element 7, 17 is inserted without play in the direction perpendicular to the connecting surface. After insertion of the connecting element 7, 17, the screws 11 are screwed into the seats 12 of the connecting element in order to clamp the two panels 1 and 2 with one another without play and to create a monolithic structure. The fastening is supported with the clamping by anchoring the screws, the vertical joint between the panels and the introduction of a foam. A plurality of connecting elements 7, 17 are advantageously used to connect the panels 1, 2.

The connecting screws advantageously have an inclination of essentially between 30° and 70°, preferably 60° (whereby essentially means +−5°). Advantageously, they can also be introduced in such a way that at least two timber layers 22, 23 are stressed with different orientation of the timber fibers. This ensures greater resistance to stress.

Advantageously, the seats 12 have a groove for receiving screw heads/clamping elements 11.

Figure 14A:
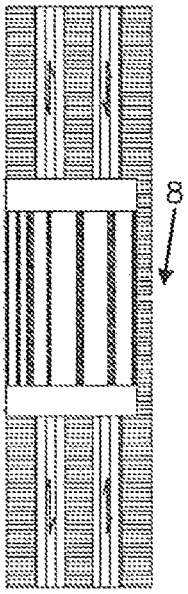
FIGS. 14A, 14B, 14C show the individual insertion steps of the screws.
Figure 14B:
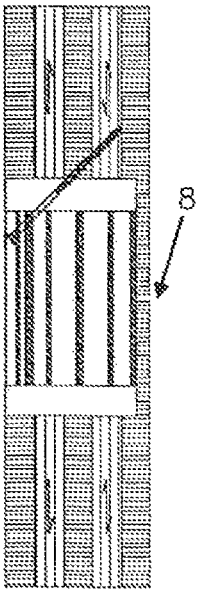
Figure 14C:
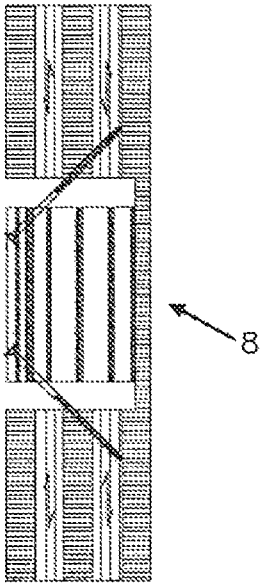
Figure 15:
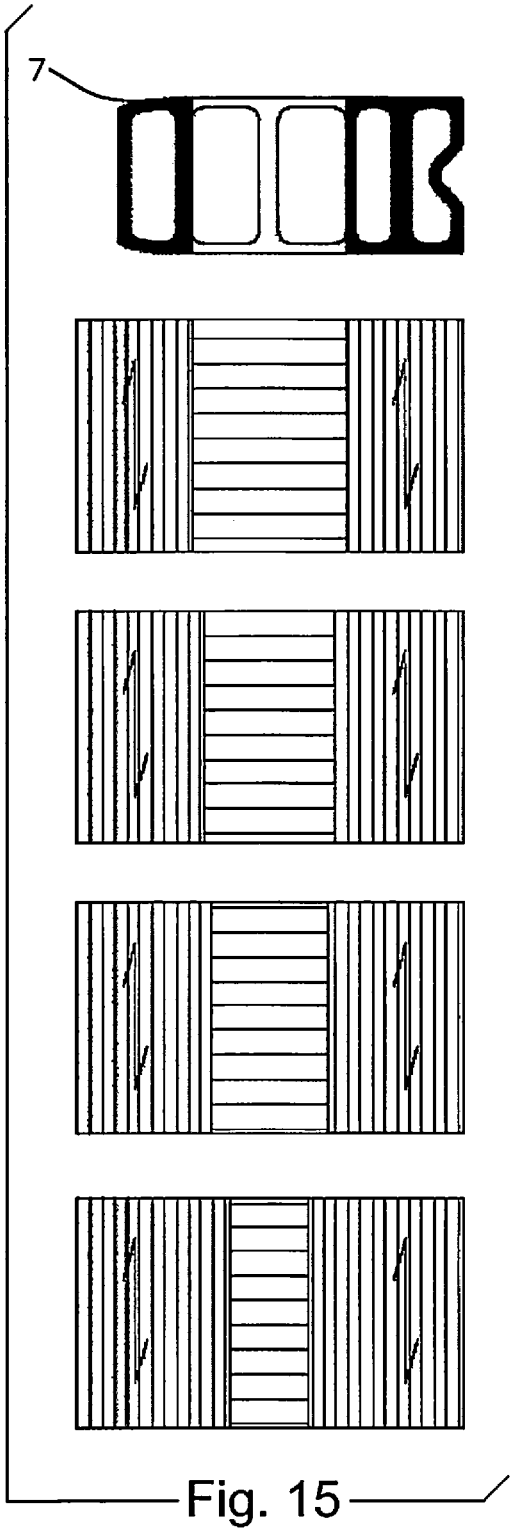
FIGS. 15 and 16 show a series of figures with connecting elements with three- or five-layer panels with different thicknesses and a connecting element.
Figure 16:
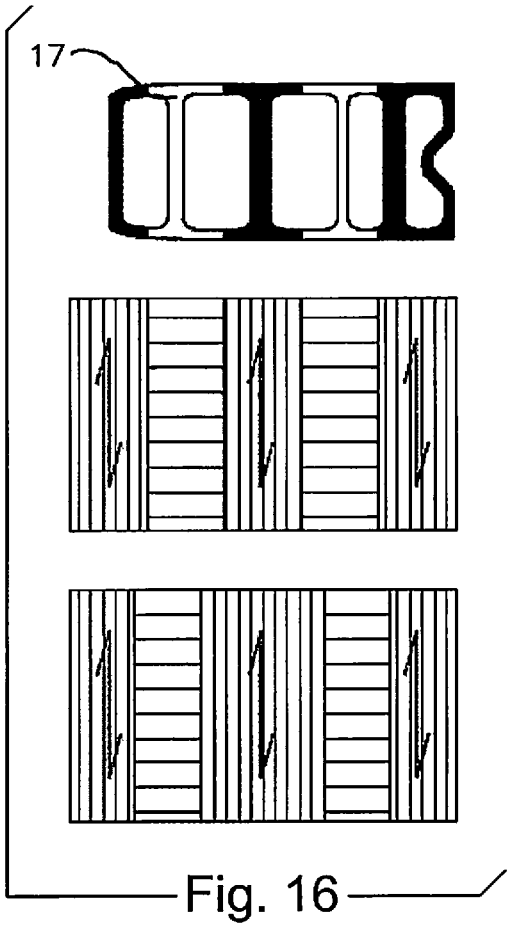

As shown in FIGS. 14A, 14B, 14C the gap 8 is present during the insertion of the connecting element 7, 17 and with the introduction of the screws 11 and their clamping by means of anchoring, FIG. 14C shows how the gap 8 is closed and the two timber panels therefore have a monolithic behavior.

In a second step, an insulating agent, for example a polyurethane foam, a resin or the like, may be introduced in order to isolate the connection. This insulating means can also support the fastening of the connecting elements 7, 17.

The connecting elements are preferably hollow with ribs arranged in the inside in order to give the element greater rigidity, wherein the entire element remains light. Advantageously, the connecting elements are made of metal, in particular aluminum, by extrusion or extrusion from reinforced polymer.

The connecting element 7, 17 preferably has a wedge shape in order to facilitate insertion into the cavity 20. In particular, only the end part of the connecting element 7, 17 is wedge-shaped, i.e. the first part that is introduced.

The openings of the connecting elements 7, 17 are advantageously filled with the insulating material.

In the subsequent step, a tape/adhesive tape is attached to the opening 20 such that the connection is sealed. Advantageously, the tape is glued on both sides along the entire contact area of the panels. This also seals the gap between the panels that might be present. The tape can be an adhesive tape provided for air sealing.

In a preferred embodiment, the cavity 20, 20*a*, 20*b* is preferably closed in timber before the tape 20 is laid by means of a closure element, for example a plug.

A structural component produced by such a method and with an element according to the invention has considerable advantages, since it can be assembled with panels with standard dimensions and still maintains the characteristics of a single panel. This structural component is not only more economical to manufacture because standard panels can be used, but is also easier to transport. The variants of the method described above and the component produced using them only serve to better understand the structure, the mode of operation and the properties of the solution presented; they do not limit the disclosure on the part of the exemplary embodiments. The figures are schematic, wherein properties and essential effects are shown in a partially enlarged manner in order to emphasize the functions, the active principles and the technical features. As a result, each mode of operation, in principle, any technical configuration and each feature, which is disclosed in the figures or the description, can be freely and arbitrarily with other patent claims, every feature in the description and in the other figures, other modes of operation, configurations and technical features can be combined, which result in or from this disclosure that all conceivable combinations of the described solution are to be taken into account. This also includes combinations between all individual explanations in the description, i.e. included in each paragraph of the description, in the claims and also combinations between different variants in the description, in the dimensions and in the figures. The details of the element and method described above and are presented in the connection; however, it should be noted that they can be combined with one another, also independently of one another and also freely one with the other. The relationships of the individual parts shown in the figures and paragraphs between each other and their dimensions and proportions are not to be understood as limiting. Individual dimensions and proportions may also differ from those shown. The claims do not limit the disclosure and therefore the possible combinations of all the features presented. All features presented are therefore also disclosed individually and in combination with all other features.

KEY FOR REFERENCE NUMBERS

1. Timber panel
2. Timber panel
3. Timber panel
4. Panel surface
5. Panel surface
6. . . .
7. Connection element
7*a*, 7*b*, 7*c*, 7*d*, 7*e* rib
8. Joint/gap
9. Boring
10. . . .
11. Screw/clamping element
12. Seat
17. Connection element
20. Receptacle
20*a*,20*b*. Cavity part
21, 22, 23, 24, 25 timber panel layers
100. structural component
101. Tensile connections
102. Surface
103. Force

The invention claimed is:

1. A method for producing a construction with a structural component formed by a plurality of interconnected timber panels wherein the timber panels are connected to each other to produce the structural component which is formed from at least two timber panels, the method comprising the following steps:

positioning at least two timber panels which fit together on a support surface which is perpendicular to the surfaces forming the structural component;

forming a cavity on a surface of two panels at the edges of the panels facing each other, wherein a cavity on at least one end face of the panel is open wherein the adjacent cavities forming a single receptacle;

pressing in a connecting element perpendicular to a face of the panel;

clamping the connecting element by means of clamping elements in an inclined direction between 30° and 70°, relative to a contact surface of the panels, and closing of a connecting gap between the two panels;

wherein at least the two panels form the structural component and are connected to another structure via two tensile connections; and covering the receptacle with a tape.

2. The method according to claim 1, further comprising introducing a polyurethane material into the receptacle.

3. The method according to claim 1, further comprising forming the timber panels with superimposed timber layers with fibers and one panel is connected to the other in such a way that the fiber of each layer in a panel plane is rotated by 90° with respect to adjacent timber layers.

4. The method according to claim 1, wherein the cavity is not continuous through the timber panels.

5. The method according to claim 1, further comprising forming at least two cavities on a surface of two timber panels on facing edges of the panels, wherein each cavity is open on one end face of the panel, wherein adjacent cavities form a single receptacle; and introducing at least two connecting elements into at least two connecting receptacles perpendicular to the face of the panel.

6. The method according to claim 1, further comprising closing the receptacle before the tape is laid with a closing element.

7. A connecting element for the method of claim 1, wherein the connecting element is formed by a longitudinal body with at least two seats for clamping elements with an inclination between 30°-70° and diametrically opposite.

8. The connecting element according to claim 7, wherein it is wedge-shaped.

9. The connecting element according to claim 7, wherein its internal structure has a series of mutually parallel ribs.

10. The connecting element according to claim 7, wherein the seat for the clamping elements has a groove for receiving a head of the clamping element.

11. The connecting element according to claim 7, wherein the connecting element is extruded in aluminum or is an extrusion of reinforced polymer.

* * * * *